US005892428A

United States Patent [19]

Hsu

[11] Patent Number: 5,892,428

[45] Date of Patent: Apr. 6, 1999

[54] THERMAL ACTUATOR

[76] Inventor: Cheng Chao Hsu, 1650, 8th Ave., #203, San Diego, Calif. 92101

[21] Appl. No.: 122,371

[22] Filed: Jul. 27, 1998

[51] Int. Cl.[6] ..... H01H 37/52; H01H 37/32

[52] U.S. Cl. ..... 337/363; 337/333; 337/318; 337/365

[58] Field of Search ..... 337/333, 318, 337/365, 390, 53, 89, 131, 362, 363, 77, 141

[56] References Cited

U.S. PATENT DOCUMENTS

| | | | |
|---|---|---|---|
| 2,237,262 | 4/1941 | Miller | 337/77 |
| 2,635,156 | 4/1953 | Welter | 337/141 |
| 3,066,206 | 11/1962 | Dales | 337/372 |
| 3,087,146 | 4/1963 | Boudouris | 340/332 |
| 3,569,887 | 3/1971 | Brown | 337/77 |
| 4,347,709 | 9/1982 | Wu et al. | 62/140 |

*Primary Examiner*—Leo P. Picard
*Assistant Examiner*—Anatoly Vortman
*Attorney, Agent, or Firm*—David and Raymond; Raymond Y. Chan

[57] ABSTRACT

A thermal actuator includes a thermal detector, an actuator unit and a connecting circuit for electrically connecting the thermal detector and the actuator unit. When a second contact member is normally remained uncontact with a first contact member of the thermal detector, the thermal actuator is an open circuit and not function. However, when the second contact member bends to contact with the first contact member due to an overheated or over-cold temperature around the thermal detector, the thermal actuator is in a close circuit and the electric current flows to an actuator unit thereof. A heat wire wrapped around an actuating piece of the actuator unit generates heat to increase the temperature around the actuating piece. When the temperature around the actuating piece increases to a predetermined extent, the actuating piece bends so as to provide an actuating action. If the actuator unit is installed close to a switch or a breaker, the actuating action of the actuating piece can activate the switch to turn off or the jumper of the breaker to cut the electric supply.

14 Claims, 5 Drawing Sheets

THERMAL ACTUATOR

FIELD OF THE INVENTION PRESENT

The present invention relates to a kind of actuator, and more particular to a thermal actuator that can automatically provide an actuating action once the temperature of a predetermined surrounding zone is overheated or over-cold. It is a universal device adapted to the overheat of various apparatus and appliances, such as an electrical circuit breaker, a motor, a refrigerator, a freezing storage, a coffee maker, a heater, a computer, and etc..

BACKGROUND OF THE PRESENT INVENTION

Most electrical appliances break down because of overheating. Overheating of an appliance or a circuit frequently causes fire or electrical shock. In order to provide a kind of protection, most houseware appliances install a fuse to prevent the overheating of the electrical wires. For the building circuitry, the bi-metal type breaker is the most common device installed in the control panel to prevent the overheating of the electrical wiring.

In the other words, those conventional thermal protectors are substantially the electrical current protection for preventing overheating of the electrical wiring. However, the surroundings around the electrical appliance has nothing for protecting against overheating or over-cold. For example, a pot of a coffee maker may also be overheated if there is no more coffee therein. It will also create danger of fire or breaking down situation. A halogen floor lamp would generate a great amount of heat therearound that has a high risk of burning stuff like the curtain around. Moreover, it is well known that the CPU of a computer generates heat during operation. If the heat accumulates around the CPU to a certain extent, the CPU will be malfunctioned. Also, a heater is an appliance for generating heat. However, the user can only control the heat by setting the power output or the timer control. It is relatively expensive and difficult to control the heater according to the actual temperature around the heater.

In fact, every electrical appliance that generates heat needs a thermal guard to prevent the surrounding being overheated or over-cold. It would be a remarkable matter if there is an inexpensive device that can cut the circuit or switch off the appliance if the surrounding thereof is too hot. It not only can prolong the service life of the appliance, but also can help the user to avoid unreasonable hazard or damages.

SUMMARY OF THE PRESENT INVENTION

It is thus a main object of the present invention to provide a thermal actuator which can provide an actuating action to break a circuit or to switch off the appliance when the temperature of a predetermined surrounding zone is higher than a safe temperature.

A further object of the present invention is to provide a thermal actuator which is a universal device adapted for installing in most kinds of electrical circuitry or appliances.

Yet another object of the present invention is to provide a thermal actuator which has a relatively economic structure and is easy to install.

In order to accomplish the above objects, the present invention provides a thermal actuator which comprises a thermal detector, an actuator unit and a connecting circuit for electrically connecting the thermal detector and the actuator unit.

The thermal detector comprises a first contact member made of electrical conducting material, a second contact member made of thermostatic metal and an insulating connector connected between a connecting end of the second contact member and the first contact member. The second contact member which is normally remained not in contact with the first contact member has a contact end which would bend towards and press against the first contact member when the temperature around the thermal detector reaches a predetermined value.

The actuator unit comprises an actuating piece made of thermostatic metal strip, a conducting terminal piece connected to the actuating piece, an insulating sleeve covering a portion of the actuating piece, and an electrical heat wire wrapping around the insulating sleeve which has one end connected to the actuating piece.

The connecting circuit comprises a first conducting wire connected between the first contact member of the thermal detector and the conducting terminal piece of the actuator unit, a first terminal, a second conducting wire connected between the second contact member of the thermal detector and the first terminal, a second terminal electrically connected with another end of the electrical heat wire. The first and second terminals are adapted to connect to the electrical circuit of an electrical appliance or any electrical circuitry.

Whereby, when the second contact member is normally remained not in contact with the first contact member, the thermal actuator of the present invention is an open circuit and does not function. However, when the second contact member bends to contact with the first contact member due to overheated or over-cold surroundings around the thermal detector, the thermal actuator is close and the electric current flows to the actuator unit. The heat wire wrapped the actuating piece generates heat to increase the temperature around the actuating piece. When the temperature around the actuating piece increases to a predetermined extent, the actuating piece bends so as to provide an actuating action. If the actuator unit is installed close to a switch or a breaker, the actuating action of the actuating piece can activate the switch to turn off the the breaker to cut the electric supply.

DETAILED DESCRIPTION OF THE PREFERRED EMBODIMENT

Figure 1:
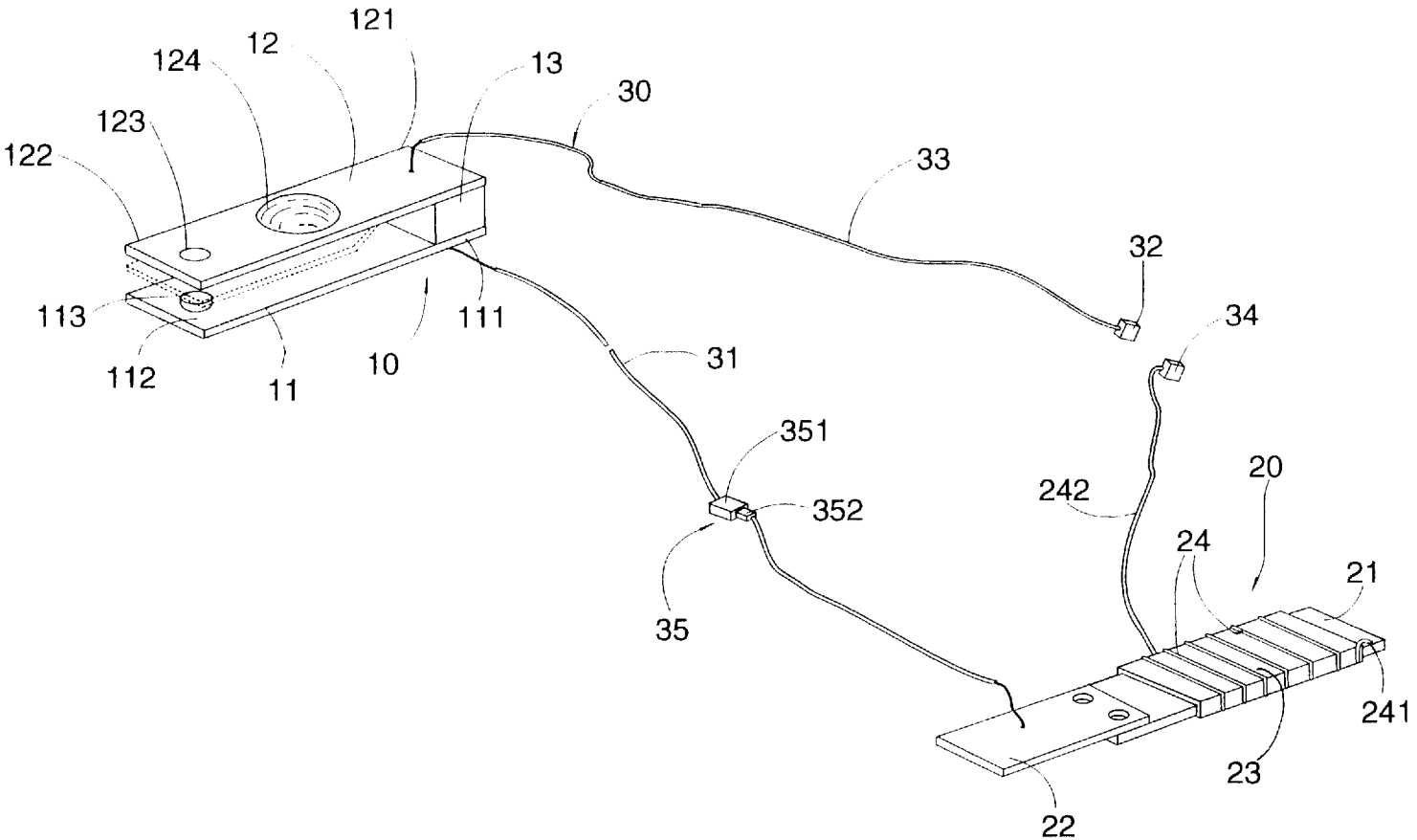
FIG. 1 is a perspective view of a thermal actuator in accordance with a preferred embodiment of the present invention, wherein the dotted lines indicated the displacement of the second contact member.

Referring to FIG. 1, a thermal actuator according to a preferred embodiment of the present invention is illustrated.

The thermal actuator comprises a thermal detector 10, an actuator unit 20 and a connecting circuit 30 for electrically connecting the thermal detector 10 and the actuator unit 20.

The thermal detector 10 comprises a first contact member 11 made of electrical conducting material such as brass, a second contact member 12 made of thermostatic metal (bi-metal) and an insulating connector 13 connected between a connecting end 121 of the second contact member 12 and a first end 111 of the first contact member 11. A second end 122 of the first contact member 11 protrudes a first contact point 113 facing to the second contact member 12. The second contact member 12 which is normally remained not in contact with the first contact member 11 has a contact end 122 which protrudes a contact point 123 aligning with the first contact point 113 and facing to the first contact member 11. The second contact member 12 would bend towards and press against the first contact member 11 when the temperature around the thermal detector 10, i.e. the second contact member 12, reaches a predetermined temperature. The predetermined temperature depends on the material nature of the second contact member 12.

On the second contact member 12, a circular concave groove 124 is formed. Accordingly, when the second contact member 12 is heated by the hot surrounding, the circular concave groove 124 ensures the contact end 122 of the second contact member 12 bending downwardly toward the first contact member 11.

The actuator unit 20 comprises an actuating piece 21 made of thermostatic metal (bi-metal) strip, a conducting terminal piece 22 connected to one end of the actuating piece 21 by spot welding, an insulating sleeve 23 covering a portion of the actuating piece 21, and an electrical heat wire 24 wrapping around the insulating sleeve 23 which has one end 241 connected to the actuating piece 21. The insulating sleeve 23 acts as an insulating layer between the surface of the actuating piece 21 and the heat wire 24 to avoid electrical contact therebetween.

The connecting circuit 30 comprises a first conducting wire 31 connected between the first contact member 11 of the thermal detector 10 and the conducting terminal piece 22 of the actuator unit 20, a first terminal 32, a second conducting wire 33 connected between the second contact member 12 of the thermal detector 10 and the first terminal 32, a second terminal 34 electrically connected with a second end 242 of the electrical heat wire 24. The first and second terminals 32, 34 are adapted to connect to the electrical circuit of an electrical appliance or any electrical circuitry.

For easy connection, a quick connector 35 is included in the first conducting wire 31. The quick connector 35 consists of two terminal connectors 351, 352, wherein the first terminal connector 351 is connected with the first contact member 11 through a first segment of the first conducting wire 31, and the second terminal connector 352 is connected with the conducting terminal piece 22 through a second segment of the first conducting wire 31. Therefore, the user may separately install the thermal detector 10 and the actuating unit 20 respectively, and then electrically connect them by connecting the first and second terminal connectors 351, 352 together.

Whereby, when the second contact member 12 is normally remained not in contact with the first contact member 11, the thermal actuator of the present invention is open and does not function. However, when the second contact member 12 bends to contact with the first contact member 11 due to overheated or over-cold surroundings around the thermal detector 10, the thermal actuator is in a close circuit and the electric current flows to the actuator unit 20. The heat wire 24 wrapped around the actuating piece 21 generates heat to increase the temperature around the actuating piece 21. When the temperature around the actuating piece 21 increases to a predetermined extent, the actuating piece 21 bends so as to provide an actuating action. If the actuator unit 20 is installed close to a switch or a breaker, the actuating action of the actuating piece 21 can activate the switch to turn off of the breaker to cut the electric supply.

Figure 2:
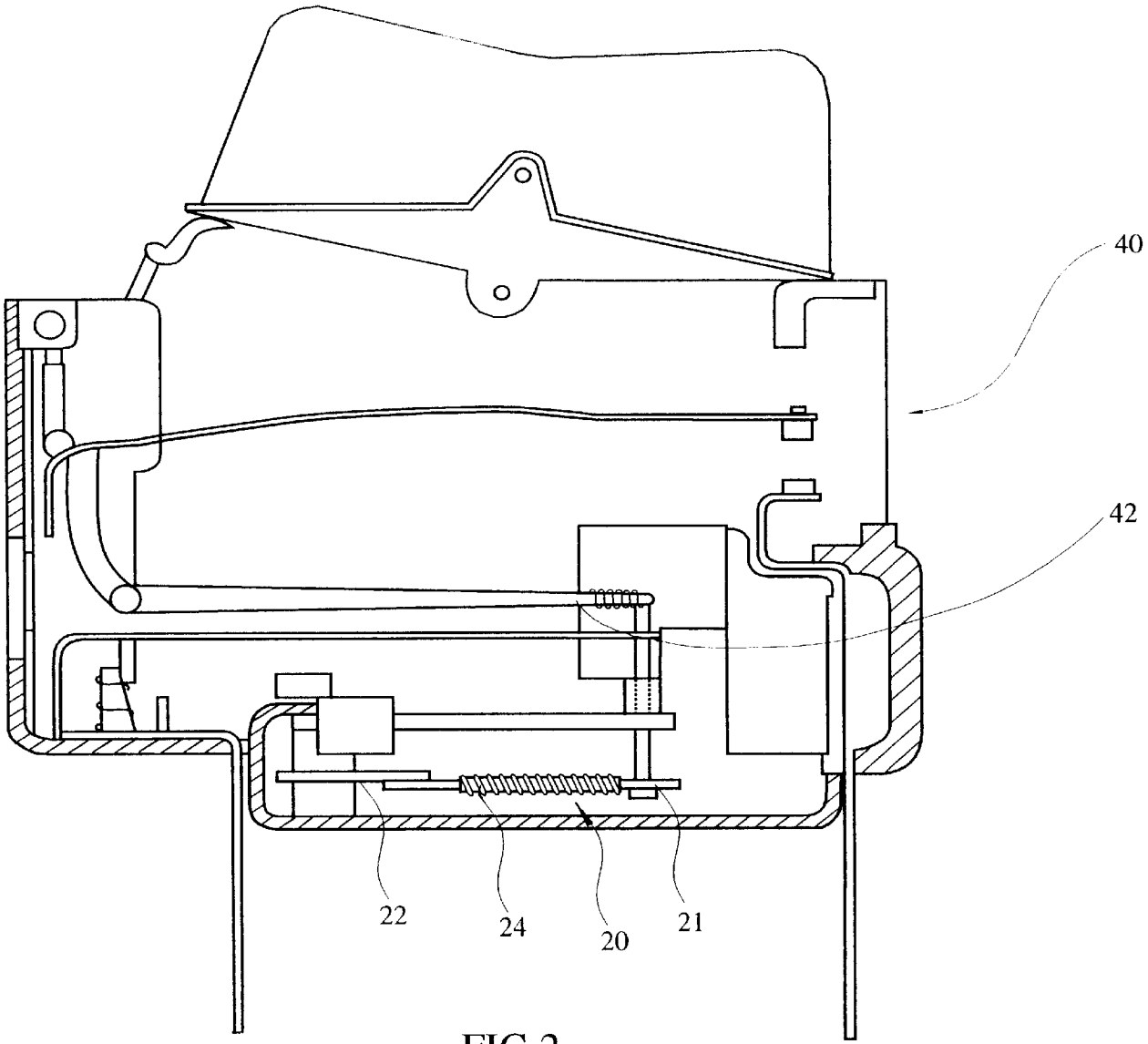
FIG. 2 is a sectional view of a breaker having an actuator unit installed therein according to the above preferred embodiment of the present invention.
Figure 3:
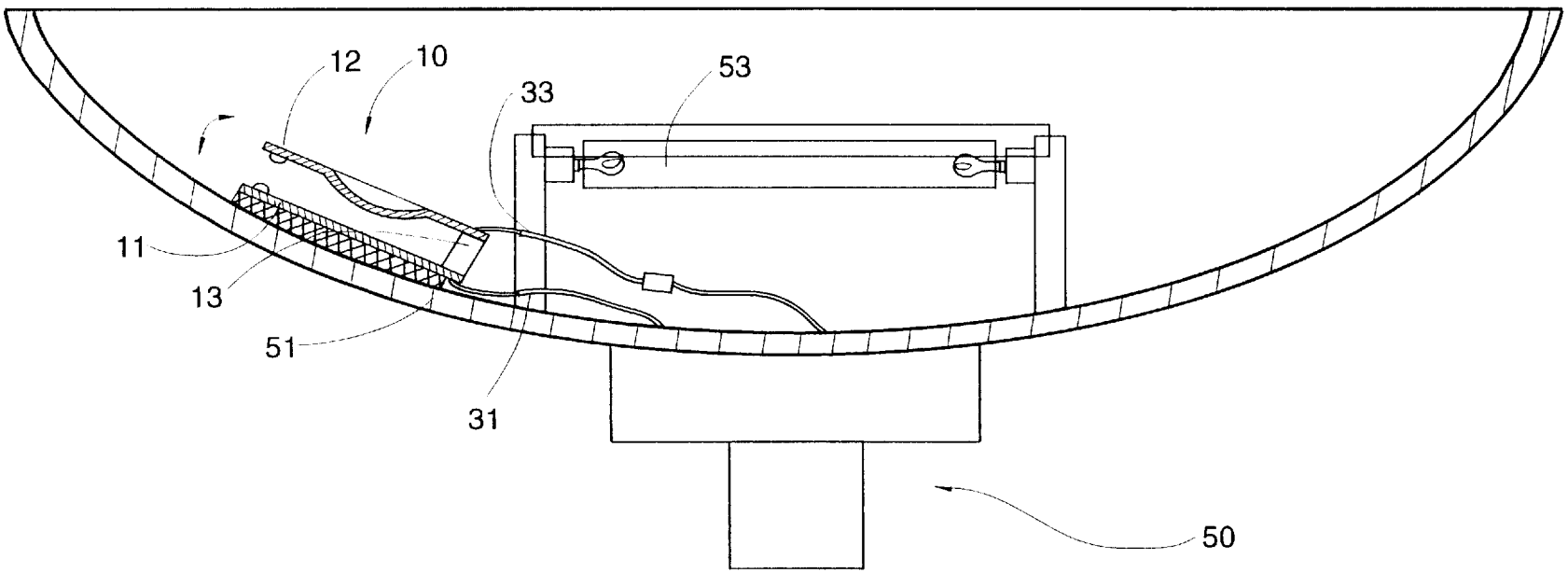
FIG. 3 is a side view of a floor having a thermal detector mounted near the halogen bulb thereof according to the above preferred embodiment of the present invention.

As shown in FIG. 2, in order to enable the person skilled in the art having a better understanding of the present invention, a practical application of the thermal actuator of the present invention is illustrated. The actuator unit 20 is mounted in a breaker switch 40, wherein the thermal detector 10 of the present invention is attached to a predetermined location along the circuit or appliance connected with the breaker 40 for sensing that whether the surroundings around the predetermined location are overheated or over-cold, such as the floor lamp head as shown in FIG. 3. When the temperature of the above mentioned predetermined location accumulating heat to a certain extent, the second contact member 12 bends to contact with the first contact member 11. Then, electric current flows through the heat wire 24 of the actuator unit 20. The actuating piece 21 responds promptly to bend upwards to drive a push rod, which is slidably mounted between the actuating piece 21 and a reboundable switch bar 42 of the breaker switch 40, to move upward and press the switch bar 42 to break off the circuit.

As shown in FIG. 3, in order to show the wide application of the present invention, an example of attaching the thermal detector 10 to a lamp head shell 51 of a halogen floor lamp 50 is illustrated. The thermal detector 10 is adhered or screwed to an inner surface of the lamp head shell 51 near the halogen bulb 53, so that if the heat generated by the halogen bulb 53 fails to dissipate and accumulates, the temperature around the lamp head shell 51 will increase. When the surrounding of the lamp head shell 51 becomes too hot to cause hazard situation, the second contact member 12 bends toward and press against the first contact member 11 so as to close the circuit of the thermal actuator. Shortly, the actuator unit 20 will respond to provide an actuating action by the bending actuating piece 21 to turn off the floor lamp 50 (not shown in FIG. 3) or to activate a warning system for the floor lamp 50.

Figure 4B:
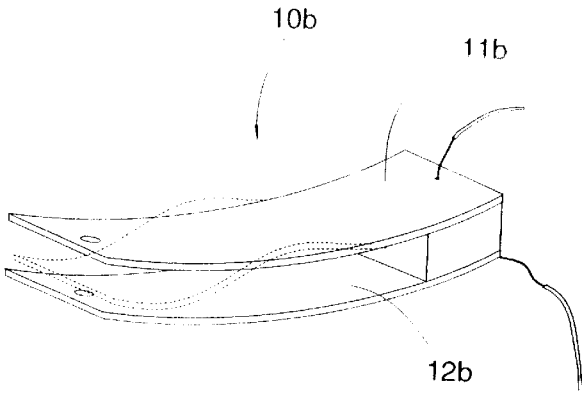
FIGS. 4A and 4B are perspective views of alternative modes of the actuator unit of the present invention.
Figure 4A:
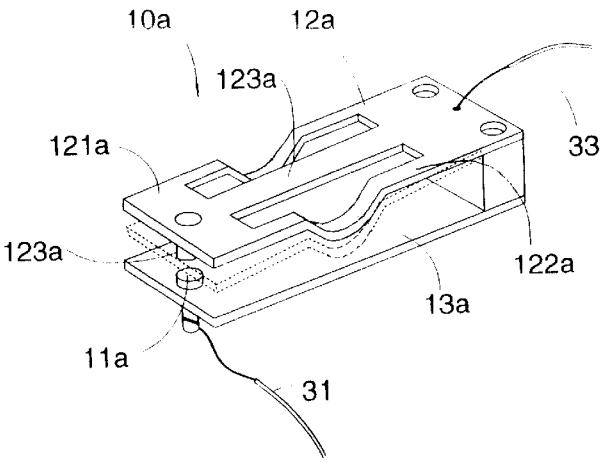

FIGS. 4A and 4B illustrate two alternative modes of the thermal detector 10 of the above preferred embodiment. As shown in FIG. 4A, the alternative thermal detector 10*a* also comprises a first contact member 11*a* which is an electrical contact terminal mounted on a L-shape insulating connector 13*a* and connected to the first conducting wire 31. The second contact member 12*a* has two downwardly indented side strips 121*a*, 122*a* connected to a flat central strip 123*a*, and a contact point 123*a* is connected to a front end of the flat central strip, 123*a*. As shown in FIG. 4B, the second alternative thermal detector 10*b* comprises two curved contact members 11*b*, 12*b* arranged and functioned similar to the above embodiment.

Figure 5A:
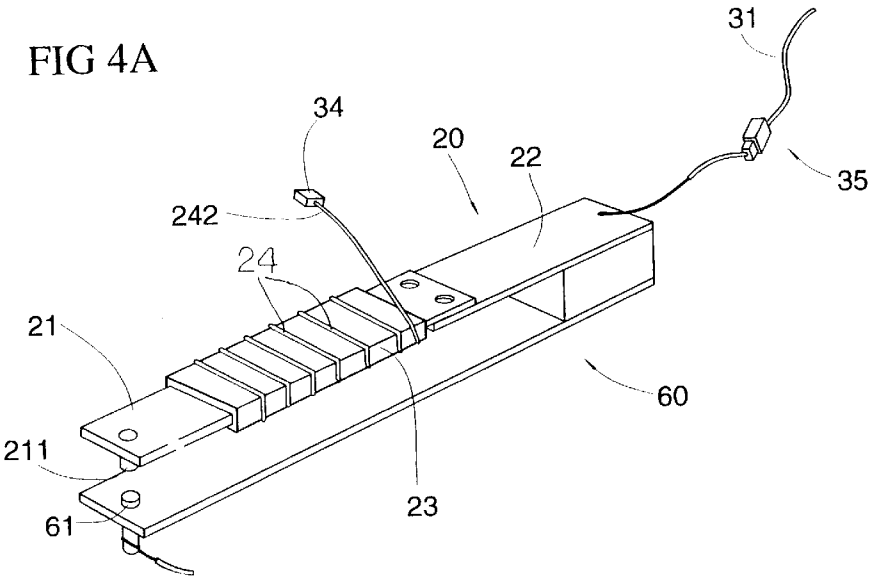
FIG. 5A is a perspective view of the actuator unit installed on to a switch contact according to the above preferred embodiment of the present invention.

As shown in FIG. 5A, the actuator unit 20 can be mounted on top of a switch contact member 60 having a switch contact point 61, so that when the actuating piece 21 bends downwardly, an actuating contact point 211 connected to a front end thereof will be rendered to contact with the switch contact point 61 to switch on an appliance (not shown) connected with the switch contact member 60.

Figure 5C:
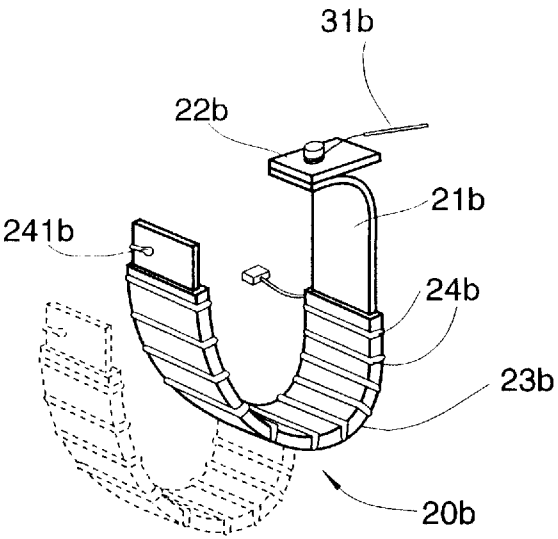
FIGS. 5B and 5C are perspective views of alternative modes of the actuator unit according to the above preferred embodiment of the present inveniton.
Figure 5B:
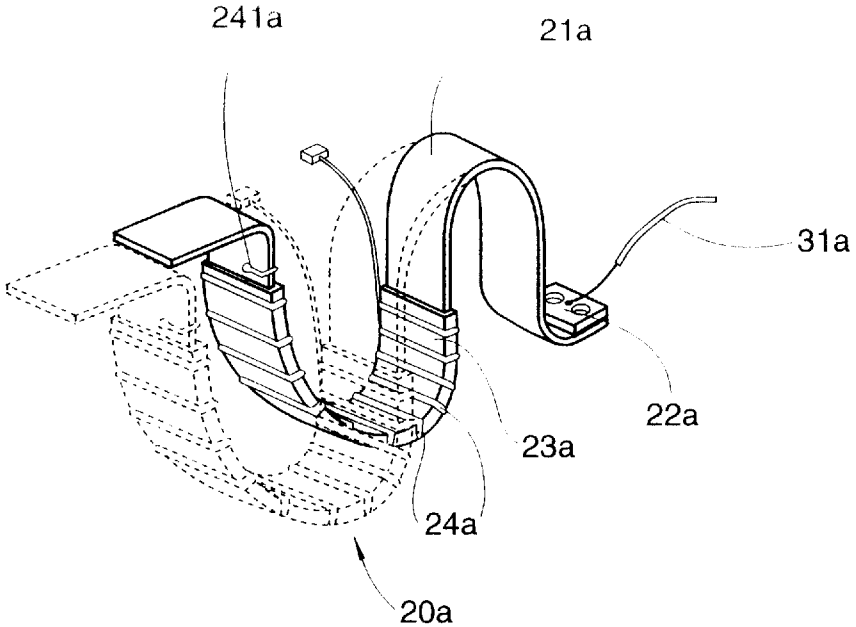

As shown in FIG. 5B, another alternative mode of the actuator unit 20*a* is illustrated, which also comprises a S-shape actuating piece 21*a* made of thermostatic metal strip, a conducting terminal piece 22*a* connected to one end of the actuating piece 21*a* to electrically connect with a conducting wire 31*a,* an insulating sleeve 23*a* covering a portion of the actuating piece 21*a,* and an electrical heat wire 24*a* wrapping around the insulating sleeve 23*a* which has one end 241*a* connected to the actuating piece 21*a.* When the temperature around the actuating piece 21 a increases to a predetermined extent by the electrical heat wire 24*a,* the S-shape actuating piece 21*a* will move forward to provide a desired actuation action, illustrated in phantom lines in FIG. 5B.

As shown in FIG. 5C, another alternative mode of the actuator unit 20*b* is illustrated, which also comprises a U-shape actuating piece 21*b* made of thermostatic metal strip, a conducting terminal piece 22*b* connected to one end of the actuating piece 21*b* to electrically connect with a conducting wire 31*b,* an insulating sleeve 23*b* covering a portion of the actuating piece 21*b,* and an electrical heat wire 24*b* wrapping around the insulating sleeve 23*b* which has one end 241*b* connected to the actuating piece 21*b.* When the temperature around the actuating piece 21*b* increases to a predetermined extent by the electrical heat wire 24*b,* the free half of the U-shape actuating piece 21*b* will move forward to provide an actuation action, illustrated in phantom lines in FIG. 5C.

In view of the above disclosure, the thermal actuator of the present invention substantially provides an actuating action when the surrounding around the thermal detector 10 suffers an overheat problem. The designer of the appliance can free to take advantage of this actuating action for responding to the overheat condition. Since the actuator unit 20 that actually provides the actuating action can be installed far away from the thermal detector 10, it is possible to freely attach the thermal detector 10 to any desired location while the actuator unit 20 is installed in the electrical circuit of the appliance. Therefore, it should be noticed that the thermal actuator can be incorporated in any all kinds of electrical circuitry or appliance, such as an electrical circuit breaker, a motor, a refrigerator, a freezing storage, a coffee maker, a heater, a computer, and etc..

What is claimed is:

1. A thermal actuator, comprising:

a thermal detector which comprises a first contact member made of electrical conducting material, a second contact member made of thermostatic metal and an insulating connector connected between a connecting end of said second contact member and said first contact member, wherein said second contact member which is normally remained not in contact with said first contact member has a contact end which would bend towards and press against said first contact member when said temperature around said thermal detector reaches a predetermined temperature;

an actuator unit which comprises an actuating piece made of thermostatic metal strip, a conducting terminal piece connected to said actuating piece, an insulating sleeve covering a portion of said actuating piece, and an electrical heat wire wrapping around said insulating sleeve which has one end connected to said actuating piece; and a connecting circuit which comprises a first conducting wire connected between said first contact member of said thermal detector and said conducting terminal piece of said actuator unit, a first terminal, a second conducting wire connected between said second contact member of said thermal detector and said first terminal, a second terminal electrically connected with another end of said electrical heat wire.

2. A thermal actuator, as recited in claim 1, wherein an end of said first contact member protrudes a first contact point facing to said second contact member and said second contact member has a contact end which protrudes a contact point aligning with said first contact point and facing to said first contact member.

3. A thermal actuator, as recited in claim 1, wherein on said second contact member, a circular concave groove is formed, so that when said second contact member is heated by a hot surrounding, said circular concave groove ensures said contact end of said second contact member bending toward said first contact member.

4. A thermal actuator, as recited in claim 2, wherein on said second contact member, a circular concave groove is formed, so that when said second contact member is heated by a hot surrounding, said circular concave groove ensures said contact end of said second contact member bending toward said first contact member.

5. A thermal actuator, as recited in claim 1, wherein said first contact member is an electrical contact terminal connected to said first conducting wire and mounted on said insulating connector which is L-shaped and that said second contact member has two downwardly indented side strips connected to a flat central strip, and a contact point which is connected to a front end of said flat central strip.

6. A thermal actuator, as recited in claim 1, wherein said second actuating piece is S-shaped and connected to said second conducting wire, and said first contact member is an electrical contact connected to said first conducting wire.

7. A thermal actuator, as recited in claim 1, wherein said second actuating piece is in U-shaped and connected to said second conducting wire, and said second contact member further has a contact point connected to a front end thereof, said first contact member being an electrical contact connected to said first conducting wire.

8. A thermal actuator, as recited in claim 1, further comprising a quick connector said quick connector comprising a first and a second terminal connector, wherein said first terminal connector is connected with said first contact member through a first segment of said first conducting wire and said second terminal connector is connected with said conducting terminal piece through a second segment of said first conducting wire.

9. A thermal actuator, as recited in claim 2, further comprising a quick connector said quick connector comprising a first and a second terminal connector, wherein said first terminal connector is connected with said first contact member through a first segment of said first conducting wire and said second terminal connector is connected with said conducting terminal piece through a second segment of said first conducting wire.

10. A thermal actuator, as recited in claim 3, further comprising a quick connector said quick connector comprising a first and a second terminal connector, wherein said first terminal connector is connected with said first contact member through a first segment of said first conducting wire and said second terminal connector is connected with said conducting terminal piece through a second segment of said first conducting wire.

11. A thermal actuator, as recited in claim 4, further comprising a quick connector said quick connector comprising a first and a second terminal connector, wherein said first terminal connector is connected with said first contact member through a first segment of said first conducting wire and said second terminal connector is connected with said conducting terminal piece through a second segment of said first conducting wire.

12. A thermal actuator, as recited in claim 5, further comprising a quick connector said quick connector comprising a first and a second terminal connector, wherein said first terminal connector is connected with said first contact member through a first segment of said first conducting wire and said second terminal connector is connected with said conducting terminal piece through a second segment of said first conducting wire.

13. A thermal actuator, as recited in claim 6, further comprising a quick connector said quick connector comprising a first and a second terminal connector, wherein said first terminal connector is connected with said first contact member through a first segment of said first conducting wire and said second terminal connector is connected with said conducting terminal piece through a second segment of said first conducting wire.

14. A thermal actuator, as recited in claim 7, further comprising a quick connector said quick connector comprising a first and a second terminal connector, wherein said first terminal connector is connected with said first contact member through a first segment of said first conducting wire and said second terminal connector is connected with said conducting terminal piece through a second segment of said first conducting wire.

* * * * *